United States Patent [19]

Hasselström

[11] Patent Number: 4,747,999

[45] Date of Patent: May 31, 1988

[54] POWDER METALLURGICAL METHOD

[75] Inventor: Per Hasselström, Norrtälje, Sweden

[73] Assignee: Uddeholm Tooling Aktiebolag, Hagfors, Sweden

[21] Appl. No.: 28,664

[22] Filed: Mar. 20, 1987

[30] Foreign Application Priority Data

Mar. 21, 1986 [SE] Sweden ..... 8601324

[51] Int. Cl.[4] ..... B22F 1/00

[52] U.S. Cl. ..... 419/49; 419/53; 419/56

[58] Field of Search ..... 419/49, 56, 53

[56] References Cited

U.S. PATENT DOCUMENTS

| | | | |
|---|---|---|---|
| 3,689,259 | 6/1969 | Hailey | 175/226 |
| 3,700,435 | 3/1971 | Chandhok | 75/214 |
| 4,171,339 | 10/1979 | Lee et al. | 264/332 |
| 4,389,362 | 6/1983 | Larsson | 419/49 |
| 4,547,337 | 10/1985 | Rozmus | 419/49 |

FOREIGN PATENT DOCUMENTS

| | | |
|---|---|---|
| 382929 | 2/1976 | Sweden . |
| 2050926A | 5/1980 | United Kingdom . |
| 2143170A | 7/1983 | United Kingdom . |
| 2140825A | 12/1984 | United Kingdom . |

OTHER PUBLICATIONS

S. Friberg, "HIP to Near Net Shape", Scandinavian Journal of Metallurgy 11 (1982), 223–225.

*Primary Examiner*—Stephen J. Lechert, Jr.
*Attorney, Agent, or Firm*—Murray and Whisenhunt

[57] ABSTRACT

A method of powder metallurgically manufacturing an article with near net shape is disclosed, the method comprising filling the mould cavity (3) of an open ceramic open mould (1), the inside walls of the cavity being precision copying cast surfaces (2), with fine particulate metal powder (5), placing the mould with its content of metal powder in an outer mould (6), and covering the ceramic open mould containing the metal powder with a bed of finely distributed particulate pressure medium (7), heating the bed of pressure medium and ceramic mould and particulate metal powder therein and subjecting the particulate pressure medium to pressure provided by at least one surface acting in an axial direction against the opening (4) of the ceramic mould, so that pressure is transferred by the particulate pressure medium to the metal powder in the mould to consolidate the metal powder to a completely dense body (21) with surfaces (22) which have been shaped by the precision cast surfaces of the mould cavity.

6 Claims, 1 Drawing Sheet

POWDER METALLURGICAL METHOD

TECHNICAL FIELD

This invention relates to a method of powder metallurgical manufacturing of an article with near net shape, i.e. a shape which approximately corresponds to the desired shaped, such that only a final adjustment working is needed to reach the desired shape.

BACKGROUND OF THE INVENTION

Swedish Pat. No. 382,929 describes a powder metallurgical method of manufacturing articles, wherein metal powder is supplied to a mould having a pattern which substantially corresponds to the shape of the desired article, the mould is placed in a container with a secondary pressure medium, the metal powder is heated to a high temperature for compacting, and the powder is subjected to isostatic consolidation by pressing at a high temperature via a gas or liquid pressure medium. It is a drawback with this method that one has to have an autoclave of an advanced type in order to obtain the high isostatic pressure at the high temperature. This equipment is very expensive, which to a high extend reduces the feasibility of the method. Moreover the use of an autoclave is troublesome and time consuming which also has an unfavourable impact upon the total economy of the method.

U.S. Pat. No. 4,499,049 describes a method for the consolidation of a metal or ceramic article, wherein a green body of powderous metal or ceramic material is first manufactured. This green body is sintered in order to increase its strength and thereafter it is placed in a bed of essentially spheroidic ceramic particles. The bed and the green body embedded in the bed are heated and compacted under a high pressure, so that the green body is consolidated to a dense body. With this technique there are only considerably limited possibilities of manufacturing articles with complicated shape. Still more limited are the possibilities of producing surfaces which have a high dimensional accuracy and smoothness. Further it is a drawback with this technique that the initial manufacturing and handling of a green body is complicated and constitutes a step which increases the costs.

DISCLOSURE OF THE INVENTION

The object of the invention is to offer an improved metallurgical method, in which the above mentioned drawbacks or limitations of the prior art methods are eliminated. The method of the present invention uses a ceramic open mould having a mould cavity, the inside walls of which are precision copying cast surfaces defining the pattern of the article to be manufactured. The mould cavity is filled with metal powder or other fine particulate solid material. The mould with its content of powder is covered by a bed of a finely distributed pressure medium in an outer mould, and the pressure medium bed with the ceramic mould provided therein, including its content of metal powder or corresponding material is heated and subjected to a high pressure under the influence of at least one pressure means acting in an axial direction against the opening of the ceramic mould so that the pressure from the pressure means is transferred axially to the fine particulate material in the mould via said pressure medium and via the opening of the mould. As a result, the fine particulate material is consolidated to a completely dense body with surfaces which have been shaped by means of said precision cast surfaces of the mould cavity.

The fine particulate material normally consists of metal powder. In this context "metal powder" includes powders of unalloyed metals as well as powders of metal alloys. The metal powder also completely or partly may consist of non-metallic material, as for example ceramic material, carbides and other hard agents. Also mixtures of several metal and/or alloy powders and/or admixtures of non-metallic powdered materials can be used. Further the fine particulate material completely or partly may consist of fibres, as for example metal fibres, ceramic fibres or carbon fibres.

In order to obtain a sufficient support of the ceramic casting mould from the outside, the outside of the mould may be designed so that it will fit well in the outer mould, which for that purpose is designed with sufficient strength. For example the outer mould may consist of an open steel container, into which the ceramic casting mould fits. It it also possible to obtain the outer support of the mould by embedding the outer ceramic mould in the fine particulate pressure medium, so that said pressure medium may support the ceramic mould from outside through lateral pressure forces. The support provided by the particulate pressure medium may possibly also be directed against the axial power direction of the pressure means, in order to prevent the mould from being substantially deformed or cracked.

The ceramic mould is made in a separate procedure, suitably by precision copying casting in a silicon rubber mould. Suitably the ceramic mould is made of a moist paste, the solid content of which substantially consists of aluminum oxide ($Al_2O_3$) containing a minor amount binder consisting of slaked lime (CaO). The content of aluminum oxide should be between 90 and 98%, while the amount of binder, i.e. the lime content, should be between 2 and 10%. The silicon rubber form in its turn is made by copying casting upon a shrinkage compensated model.

Before the precision cast mould cavity in the ceramic mould is filled with metal powder, the forming surfaces of the mould cavity may be covered with hard agents or a layer of very fine particulate metal powder. These hard agents or layers can afterwards be transferred to the article to be produced in order to achieve hard or very even surfaces thereon.

The pressure medium, which can have the form of fine particulate powder, can as previously known in the art through U.S. Pat. No. 4,499,049, e.g. consist of covered or uncovered ceramics such as graphite, boron nitride, etc. Alternatively the pressure medium may consist of glass, refractory metal powders such as molybdenum and/or tungsten, ormetals melting at low temperature with low vapour pressure at the forging temperature such as lead or of mixtures of one or more of such materials. In case the pressure medium consists of a covered ceramic powder the covering layer consists, as is well known in the art, of a thermally stable, essentially unreactive lubricant such as e.g. graphite. Whether the pressure medium consists of either a ceramic, graphite or a material with a lower melting point than the forging temperature of the powder in the mould, the pressure medium is warmed up, preferably in a protecting gas atmosphere in a special container e.g. in a so-called fluidized bed, until it has reached the forging temperature (which means the temperature at which the fine particulate material in the mould is consolidated to a completely dense body). Meanwhile the ceramic container with its content of fine particulate solid material is heated in an inert or slightly reducing gas atmosphere to the forging temperature (consolidation temperature). The pressure medium and the ceramic mould with its content of particulate material are thereafter transferred to the above mentioned outer mould, which may be designated the forging mould. This is carried out in such a way that the pressure medium will completely cover the ceramic mould with its contents. Thereafter pressure is applied to the pressure medium by means of a pressure tool, e.g. in the same way as described in the above mentioned U.S. Pat. No. 4,499,049, the disclosure of which is essentially integrated by reference.

Further characteristics, aspects and advantages related to the invention will become apparent from the following description of a preferred embodiment.

BRIEF DESCRIPTION OF DRAWINGS

In the following description of a preferred embodiment reference will be made to the attached drawn figures, of which FIG. 1 schematically illustrates the manufacturing technique and the corresponding equipment.

DESCRIPTION OF A PREFERRED EMBODIMENT

Figure 1:
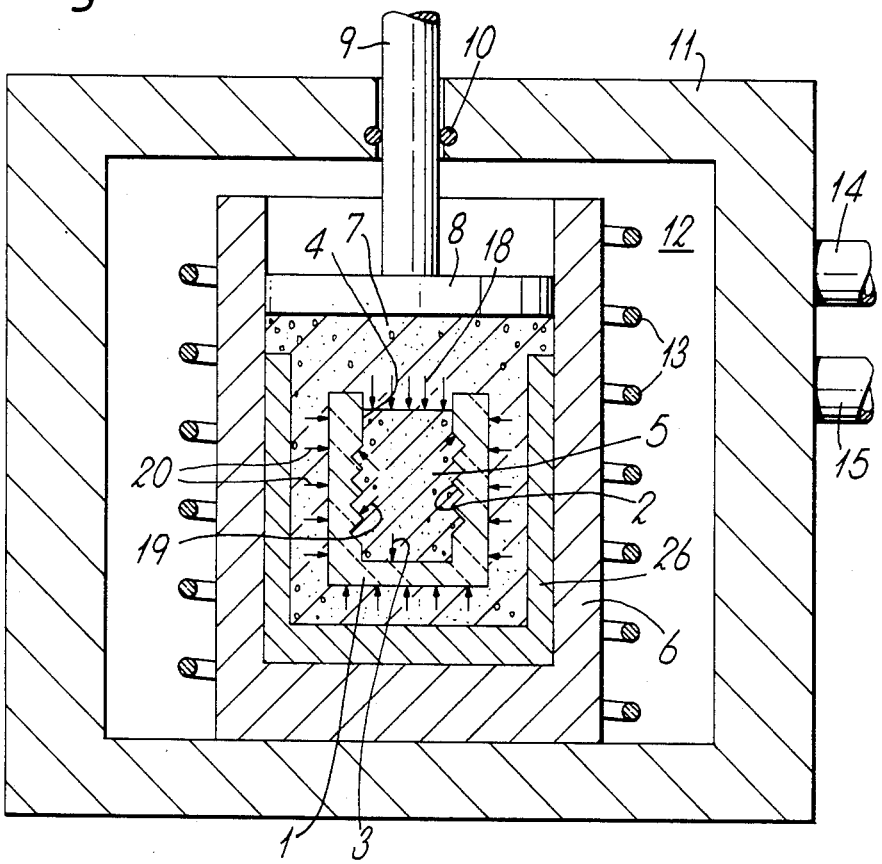

In FIG. 1 a ceramic mould is designated with the numeral 1. It is manufactured by means of a cast taken in a mould of silicon rubber of a model, of the general shape of which, which with precision and shrinkage allowance corresponds to the copying surfaces 2 in the mould cavity 3 of the mould 1. The mould 1 is open. The aperture has been designated 4. The mould 1 consists mainly of $Al_2O_3$ with appr 4% CaO as binder.

A fine particulate pressure medium consisting of spheroidic $Al_2O_3$, which on its outer surface is covered with graphite, is heated in a fluidized bed in protective gas ($N_2$) atmosphere in a separate container until it has acquired a temperature corresponding to the consolidat ion temperature for the metal powder which is to be consolidated to a dense body. This temperature can be chosen between the melting point of the metal powder and $0.5 \times T_m$°K., where $T_m$ is the melting point expressed in degrees Kelvin. Meanwhile the ceramic mould 1 is filled with metal powder 5 of the composition 1.27% C, 4.2% Cr, 5.0% Mo, 6.4% W, 3.1% V, balance iron and impurities and heated in an inert argon gas (or slightly reducing gas atmosphere) until it reaches the consolidation temperature. The ceramic mould 1 with metal powder 5 is thereafter transferred to a forging mould 6 and embedded in the finely distributed, heated pressure medium 7.

The metal powder 5 in the mould cavity 3 preferably consists of a high alloy steel powder for the production of cutting tools (preferably high speed steel powder).

The forging mould 6 can consist of steel having eventually an interior graphite lining 26.

A movable punch 8 is provided in the forging mould 6. It is axially movable, i.e. movable upwards and downwards, in the forging mould 6 by means of a rod 9, which passes through a sealed inlet 10 of an oven 11, in which the forging mould 6 is placed. The interior 12 of the oven can be heated by means of interior heating elements 13. The interior 12 of the oven can also be subjected to a gas flow through the connections 14, 15. This is preferably used in connection with production according to the invention by evacuating the air in the interior 12 of the oven with protective gas, e.g. nitrogen, before the metal powder is consolidated. At consolidation, as also described above, the piston or punch 8 is pressed down by the rod 9. The finely powdered pressure medium 7 will thereby exert an axial pressure on the metal powder 5, which pressure is symbolically indicated by the arrows 18 at the aperture 4 of the mould. This pressure is transmitted through the metal powder 5 in such a way that it at the temperature in question consolidates to a completely dense body, with a configuration which matches the copying surfaces of the mould 3. The metal powder 5 in the mould cavity 3 will thus exert a pressure on the copying surfaces 2. This pressure is symbolized by the arrows 19. At the same time the pressure medium 7 exerts a counteracting pressure in the opposite direction symbolized by the arrows 20 on the outside of the mould 1 including its bottom. It is also possible to place the mould 1 directly on the bottom of the forging mould 6, which then produces the counter-pressure required from below. As mentioned in the disclosure of the invention it is also possible to give the exterior of the mould 1 such a configuration that it can be slid into the forging mould 6 or into the lining 26 with a such a fit that the lateral surfaces of the mould 1 are supported by the forging mould 6.

Figure 2:
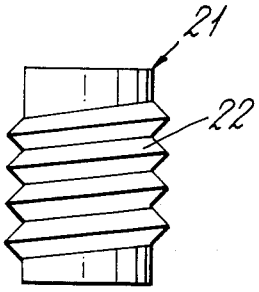
FIG. 2 shows an article, which has been produced in accordance with the invention.

When the desired article 21, FIG. 2, thus has been consolidated, the temperature in the interior 12 of the oven is lowered, the mould 1 is taken out and the pressure medium 7 is cleared therefrom. The ceramic mould 1 is crushed to recover article 21, and the consolidated product 21 is ground to the desired shape at its part which during consolidation was located at the aperture 4. As a result, article 21 is thus obtained with irregular surfaces 22, which have been precision cast against the copying surfaces 2 of the ceramic mould 1.

I claim:

1. A method of powder metallurgically manufacturing an article with near net shape, said method comprising:

providing an open ceramic mould having an exterior, an internal cavity and an opening in communication with said internal cavity, said internal cavity having inside walls which are precision copying cast surfaces;

filling said internal cavity of said open ceramic mould with fine particulate metal powder through said opening to give a metal powder-containing open ceramic mould;

placing said metal powder-containing open ceramic mould in an outer mould;

covering said metal powder-containing open ceramic mould in said outer mould with a bed of finely distributed particulate pressure medium;

heating said bed of particulate pressure medium and said metal powder-containing open ceramic mould and subjecting said particulate pressure medium to pressure by at least one surface acting against said opening of said metal powder-containing open ceramic mould in an axial direction towards said open ceramic mould, whereby pressure is transferred by said particulate pressure medium to said metal powder in said open ceramic mould to consolidate said metal powder and form a completely dense body with surfaces shaped by said precision cast surfaces of said internal cavity.

2. Method of claim 1, wherein at the same time said pressure medium via said metal powder exerts a pressure against said inside walls of said internal cavity, said pressure medium also supports said exterior or said mould by pressure forces which are directed radially with respect to said axial direction of said mould to prevent said mould from being essentially deformed or crushed.

3. Method of claim 1, wherein said open ceramic mould is fitted into said outer mould, with said outer mould supporting said exterior of said ceramic mould to prevent said ceramic mould from being essentially deformed or crushed.

4. Method of claim 1, wherein said particulate pressure medium is heated to a temperature in the region between the melting point of said metal powder and $0.5 \times T_m$°K., where $T_m$ is the melting point of said metal powder expressed in degrees Kelvin, prior to contacting said ceramic mould, and said ceramic mould and metal powder contained therein are heated to a temperature in said temperature region prior to contact with said pressure medium.

5. Method of claim 1, wherein said metal powder is consolidated at a temperature between the melting point of said metal powder and $0.5 \times T_m$°K. where $T_m$ is the melting point of said metal powder expressed in degrees Kelvin.

6. Method of claim 5, wherein the temperature utilized in said method are below the melting point and softening point of said pressure medium.

* * * * *